US012716651B2

(12) United States Patent
Hirose

(10) Patent No.: US 12,716,651 B2
(45) Date of Patent: Aug. 25, 2026

(54) AIR SEPARATION UNIT AND AIR SEPARATION METHOD

(71) Applicant: L'Air Liquide, Societe Anonyme pour l'Etude et l'Exploitation des Procedes Georges Claude, Paris (FR)

(72) Inventor: Kenji Hirose, Kobe (JP)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 343 days.

(21) Appl. No.: 18/231,855

(22) Filed: Aug. 9, 2023

(65) Prior Publication Data

US 2024/0053097 A1 Feb. 15, 2024

(30) Foreign Application Priority Data

Aug. 9, 2022 (JP) ..... 2022-127139

(51) Int. Cl.
*F25J 3/00* (2006.01)
*F25J 3/04* (2006.01)

(52) U.S. Cl.
CPC ..... *F25J 3/04636* (2013.01); *F25J 3/04321* (2013.01); *F25J 3/0443* (2013.01); *F25J 2200/32* (2013.01); *F25J 2205/02* (2013.01); *F25J 2215/56* (2013.01); *F25J 2220/52* (2013.01); *F25J 2230/42* (2013.01); *F25J 2235/52* (2013.01); *F25J 2245/40* (2013.01); *F25J 2270/42* (2013.01)

(58) Field of Classification Search
CPC .. F25J 3/04636; F25J 2215/56; F25J 2200/32; F25J 2220/04
See application file for complete search history.

(56) References Cited

U.S. PATENT DOCUMENTS

| | | | | |
|---|---|---|---|---|
| 5,049,173 | A * | 9/1991 | Cormier, Sr. ..... | F25J 3/04284 62/646 |
| 5,257,504 | A | 11/1993 | Agrawal | |
| 5,596,885 | A | 1/1997 | Grenier | |
| 5,921,107 | A | 7/1999 | Yamamoto | |
| 6,050,106 | A * | 4/2000 | Yamamoto ..... | F25J 3/04284 62/643 |
| 6,460,373 | B1 * | 10/2002 | Bergman, Jr. ..... | F25J 3/04454 62/652 |

(Continued)

FOREIGN PATENT DOCUMENTS

| | | |
|---|---|---|
| CN | 107 726 732 | 2/2018 |
| CN | 210 512 327 U | 5/2020 |

(Continued)

*Primary Examiner* — Brian M King
(74) *Attorney, Agent, or Firm* — Justin K. Murray

(57) ABSTRACT

The method for reducing or removing non-volatile impurities in a high-purity oxygen liquid comprises: an oxygen vaporization step for vaporizing a high-purity oxygen liquid obtained from a high-purity oxygen rectification column in an air separation unit for producing the high-purity oxygen liquid; and an oxygen recondensing step for recondensing oxygen gas vaporized in the oxygen vaporization step. This method may also comprise a high-purity oxygen liquid extraction step for extracting a condensate obtained in the oxygen recondensing step.

14 Claims, 4 Drawing Sheets

(56) References Cited

U.S. PATENT DOCUMENTS

| | | | | |
|---|---|---|---|---|
| 7,134,297 | B2 * | 11/2006 | Corduan | F25J 3/04878 62/643 |
| 2006/0005704 | A1 * | 1/2006 | Zhou | B01D 53/02 95/117 |
| 2006/0278299 | A1 * | 12/2006 | Jang | F04B 43/067 141/2 |
| 2015/0316317 | A1 * | 11/2015 | Goloubev | F25J 3/04878 62/643 |
| 2016/0069611 | A1 | 3/2016 | Lochner | |
| 2016/0123662 | A1 * | 5/2016 | Kirchner | F25J 3/04418 62/652 |
| 2020/0182543 | A1 * | 6/2020 | Hirose | F25J 3/0443 |
| 2021/0080171 | A1 * | 3/2021 | Hirose | F25J 3/08 |

FOREIGN PATENT DOCUMENTS

| | | |
|---|---|---|
| JP | H09 303 959 | 11/1987 |
| JP | H10 122 740 | 5/1988 |
| JP | H03 230080 | 10/1991 |
| JP | 3 719 832 | 11/2005 |
| JP | 3 929 799 | 6/2007 |
| JP | 2016 188751 | 11/2016 |
| JP | 6 546 504 | 7/2019 |
| JP | 2022 029786 | 2/2022 |
| WO | WO 2014 173496 | 10/2014 |

* cited by examiner

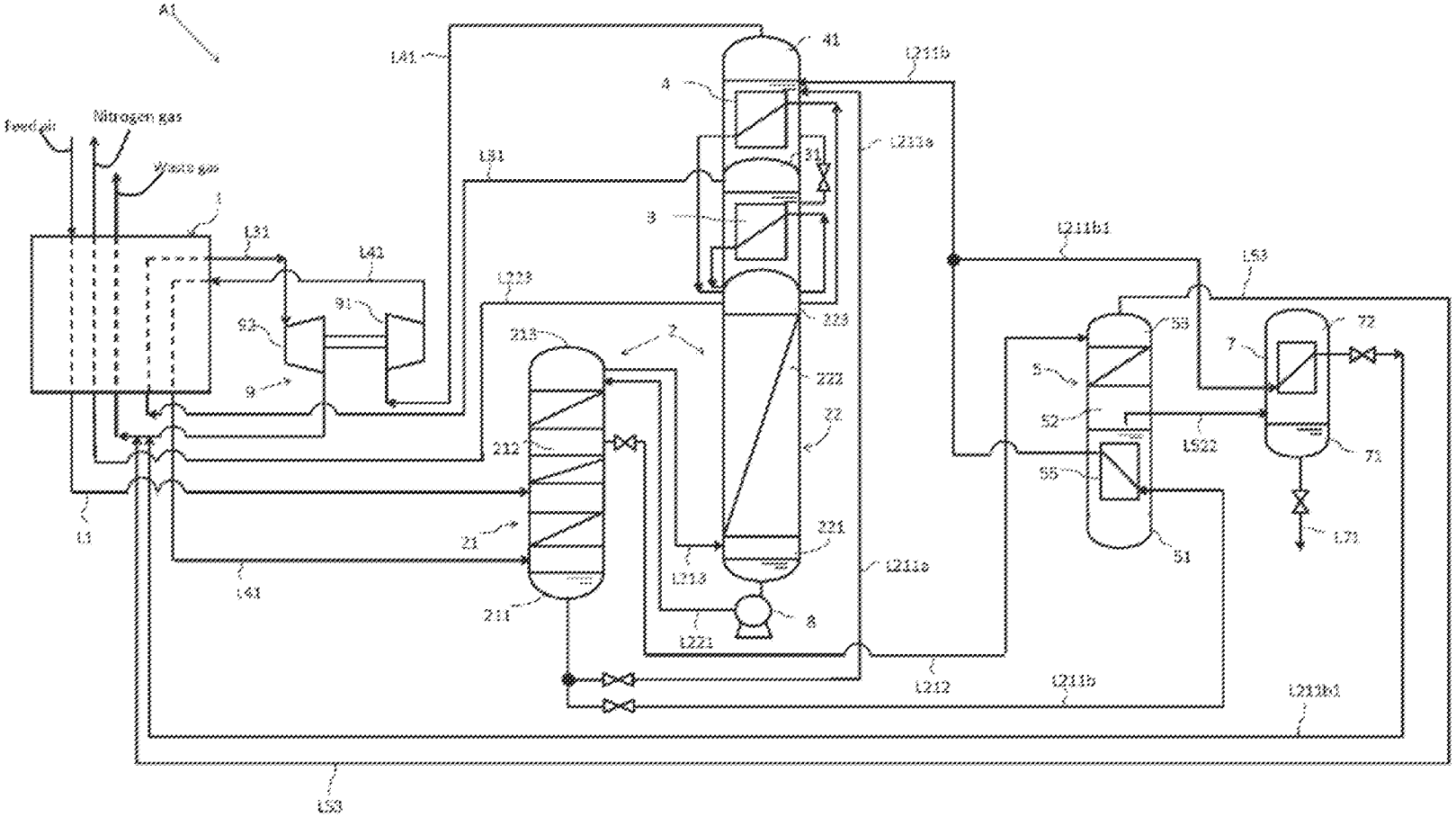
[Fig. 1]

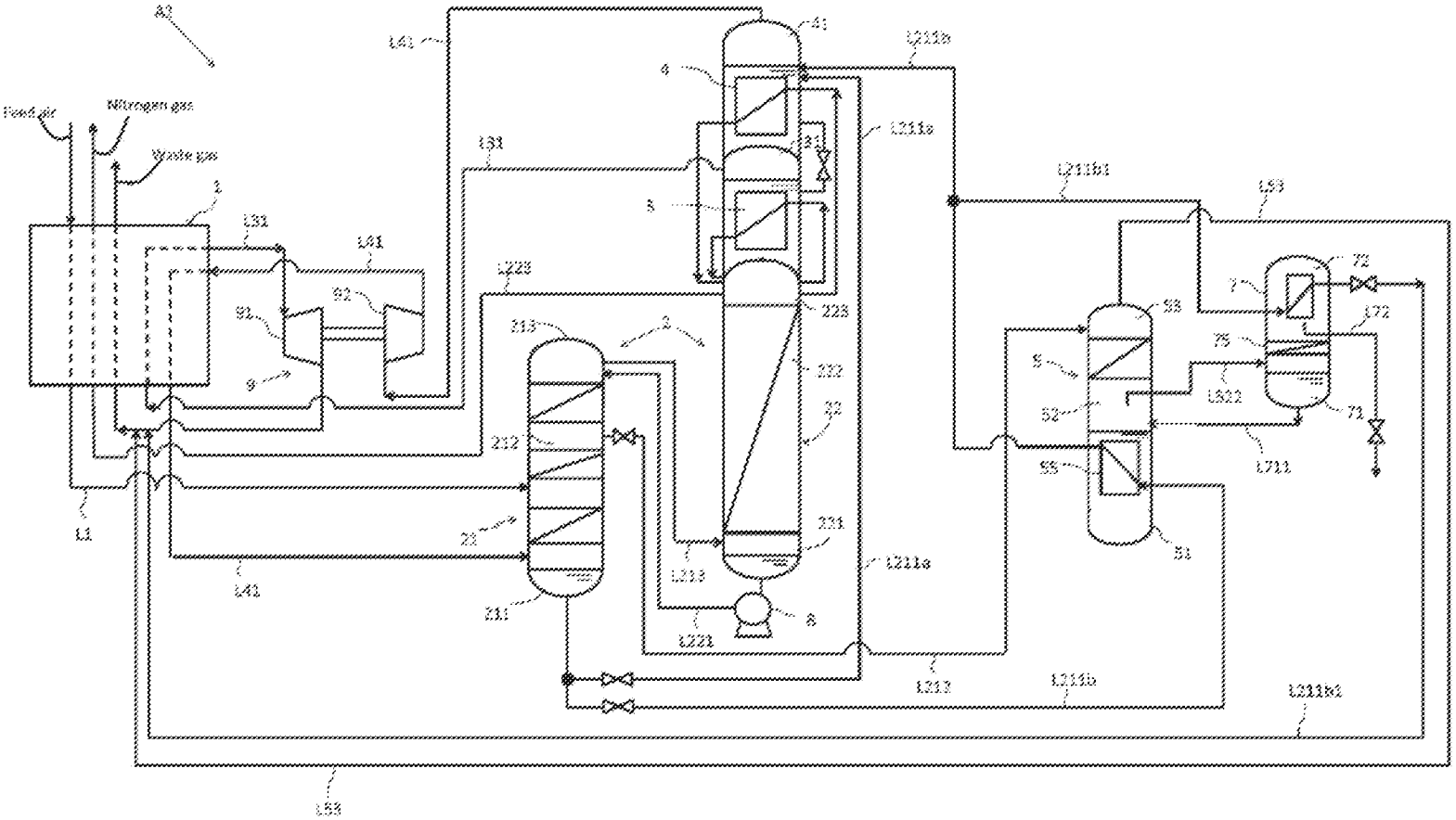
[Fig. 2]

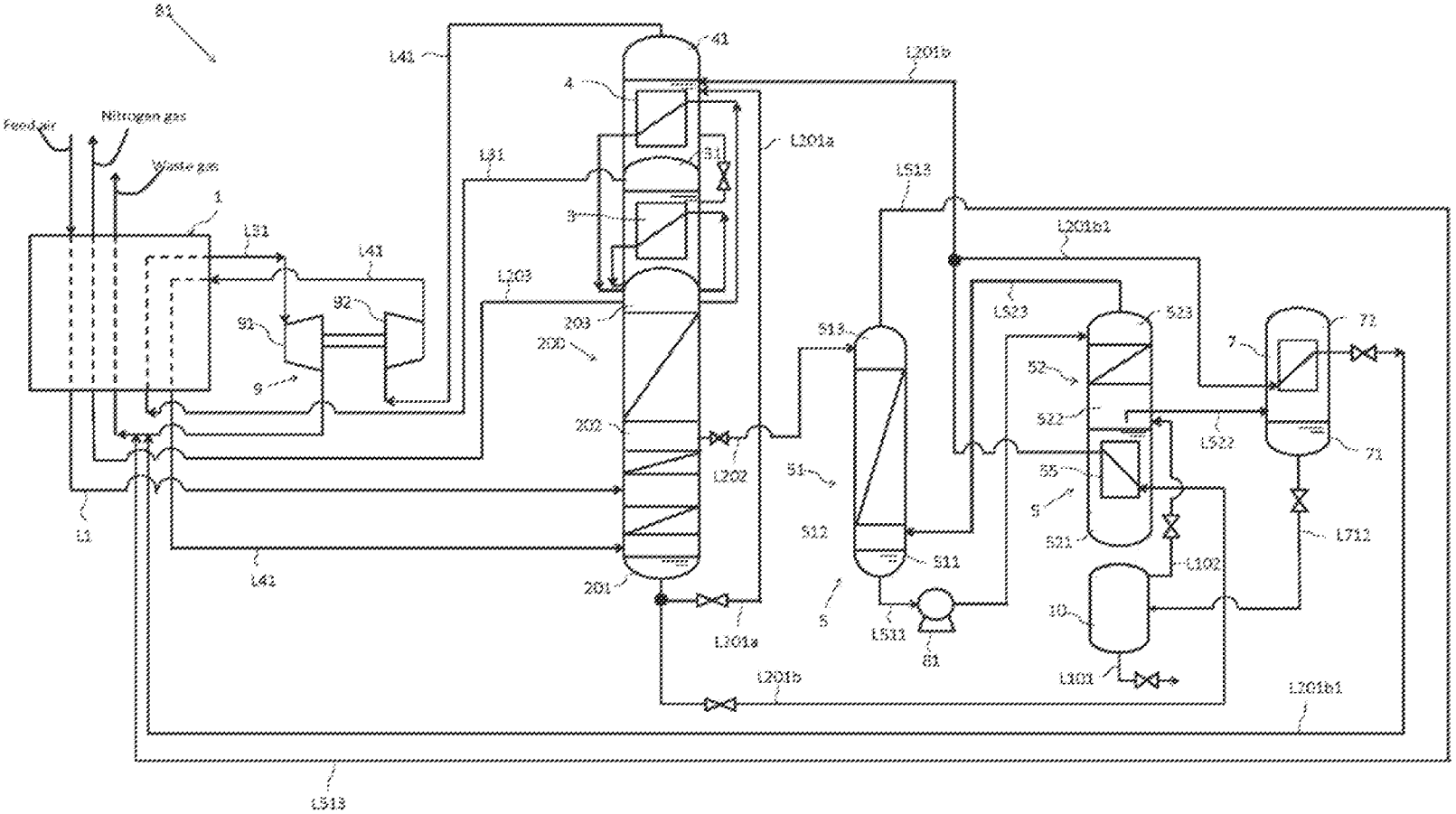
[Fig. 3]

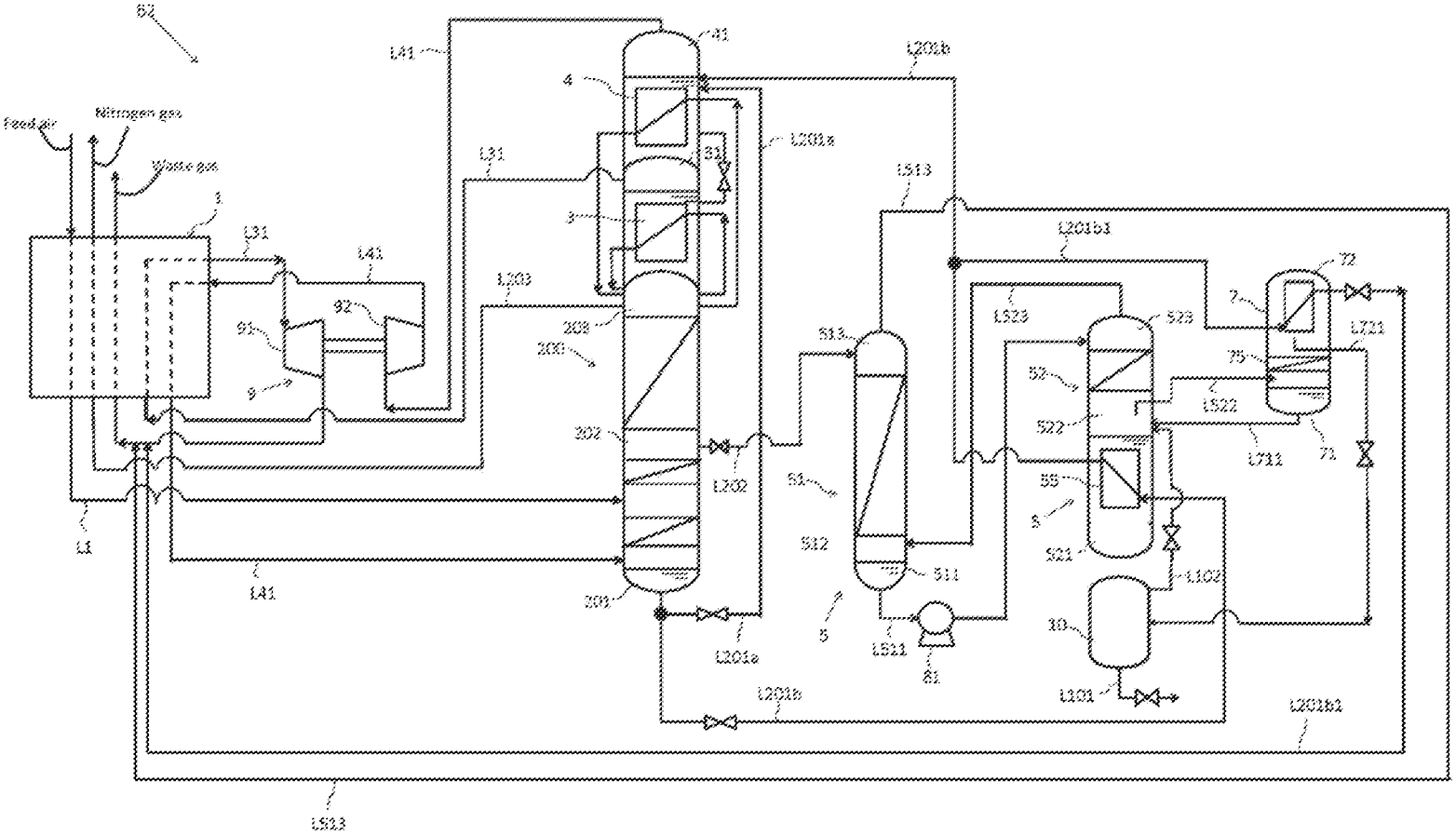
[Fig. 4]

AIR SEPARATION UNIT AND AIR SEPARATION METHOD

CROSS REFERENCE TO RELATED APPLICATIONS

This application claims the benefit of priority under 35 U.S.C. § 119 (a) and (b) to French patent application No. JP2022-127139, filed Aug. 9, 2022, which is herein incorporated by reference in its entirety.

FIELD OF THE INVENTION

The present invention relates to an air separation unit and an air separation method for producing high-purity oxygen.

BACKGROUND OF THE INVENTION

High-purity oxygen is oxygen having a purity of, e.g. 99.9999% or greater, which is demanded by the semiconductor industry, for example, and high-boiling-point components (e.g., hydrocarbons such as methane) and low-boiling-point components (nitrogen, argon, hydrogen, etc.) have been stripped from this oxygen as impurities.

Non-volatile components (metal particles and siloxanes, etc.) also need to be removed as impurities. Impurities comprising a non-volatile component can be removed by a filtration treatment using a filter when the particle size of the impurities is sufficiently large, but removing particles of the nanometre order is technically difficult, and materials that may form a source of pollution are generally excluded from the process of producing high-purity oxygen.

In order to obtain high-purity air separation gas, the rectification column of an air separation unit has a greater number of theoretical stages and the height of the rectification column increases as a result, but it may be suitable to divide the rectification column because of length constraints relating to transportation of the air separation unit, and installation height constraints at the installation site.

In addition to constraints on construction methods using cranes, etc., the height may also be restricted by regulations due to aviation law, electric utilities law, and landscape ordinances, etc.

A rectification column which is divided because of the height constraints is preferably set up to the same height level. In this case, a bottom liquid in the rectification column corresponding to an upper portion needs to be supplied to the top of the rectification column corresponding to a lower portion as a reflux liquid, which therefore requires a pump to feed the liquid from the upper rectification column bottom to the lower rectification column top.

The rectification process in an air separation unit is used at a low temperature of around −196° C., which is the liquefaction point of nitrogen, so the materials used are austenitic stainless steel, or aluminium alloy or copper alloy, etc., which do not exhibit low-temperature brittleness. An oxide film is formed on the surface of the materials under a static usage environment so corrosion of the materials does not occur, but abrasive corrosion may arise in sliding parts and rotating parts in the case of materials applied to moving machinery such as pumps having a drive unit. Metal impurity contaminating a fluid due to corrosion essentially moves to a liquid phase because it is non-volatile, becoming concentrated in the oxygen in the air separation unit.

Metal and metal oxide particles produced by such corrosion may have a size of the order of several tens of nanometres, which could be catastrophic impurities in semiconductor production, and these may lead to sizeable losses once a problem has arisen in the semiconductor production process causing a stoppage in the process, a problem which is especially marked in the production of leading-edge semiconductors where the semiconductor circuits have a width of several nanometres.

It is therefore essential to remove impurities in high-purity oxygen used in the semiconductor production process, but because of the technical difficulty in using a filter, etc. to remove particles of the order of several tens of nanometres, there is a need to develop treatment technology employing an air separation unit.

JP 6546504 B2 describes an oxygen production system capable of producing at least one of high-purity oxygen gas and high-purity liquid oxygen, while keeping any effects on an existing nitrogen production process to a low level. JP 3719832 B2 and JP 3929799 B2 describe apparatuses for producing high-purity oxygen. However, JP 6546504 B2 and JP 3929799 B2 do not mention the problem of metal impurities concentrated in oxygen.

SUMMARY OF THE INVENTION

The present disclosure provides an air separation unit for removing or reducing non-volatile impurities in a high-purity oxygen liquid, and a method for reducing or removing non-volatile impurities in a high-purity oxygen liquid.

Embodiments of the Invention

The method for reducing or removing non-volatile impurities in a high-purity oxygen liquid according to the present disclosure may comprise: an oxygen vaporization step for vaporizing (in an oxygen vaporizer) a high-purity oxygen liquid obtained from a high-purity oxygen rectification column in an air separation unit for producing the high-purity oxygen liquid; and an oxygen recondensing step for recondensing (liquefying) (in an oxygen recondenser) oxygen gas vaporized in the oxygen vaporization step.

The oxygen recondensing step may comprise introducing the vaporized oxygen gas below an oxygen mist separator.

This method may comprise a high-purity oxygen liquid extraction step for extracting a condensate (high-purity oxygen liquid) obtained in the oxygen recondensing step.

The high-purity oxygen liquid extraction step may comprise a step for extracting a condensate (high-purity oxygen liquid) from above the oxygen mist separator.

The high-purity oxygen liquid extraction step may comprise a pressurization step for pressurizing the condensate, and may comprise a step for vaporizing and gasifying the condensate.

"High-purity oxygen" means oxygen having a purity of 99.9999% or greater, for example.

Air separation units (A1, A2) according to the present disclosure may comprise: a nitrogen rectification column (2) having a first nitrogen rectifying portion (21) in which high-boiling-point components are concentrated, and a second nitrogen rectifying portion (22) in which low-boiling-point components are concentrated; and a high-purity oxygen rectification column (5). The first nitrogen rectifying portion (21) and the second nitrogen rectifying portion (22) may be separated due to constraints such as height constraints. A liquid feed pump (8) may be provided for feeding an oxygen-rich liquid collected in a bottom (221) of the second nitrogen rectification column (22) (feeding a reflux liquid) to a column top (213) of the first nitrogen rectifying portion (21). The liquid feed pump (8) is used because there is a head difference.

The air separation units (A1, A2) may comprise:

- a main heat exchanger (1) for subjecting feed air to heat exchange;
- a first nitrogen rectifying portion (21) (comprising an intermediate or lower rectifying portion) into which the feed air that has passed through the main heat exchanger (1) is introduced;
- a second nitrogen rectifying portion (22) having a rectifying portion (222) (lower rectifying portion) into which a gas (vaporized gas) drawn from a column top (213) of the first nitrogen rectifying portion (21) is introduced;
- first and second condensers (3, 4) into which a gas (vaporized gas) drawn from a column top (223) of the second nitrogen rectifying portion (22) is introduced, the first and second condensers (3, 4) condensing (cooling) this gas and returning it to the column top (223);
- an expander (92) for expanding a gas drawn from a column top (31) of the first condenser (3), after the gas has passed through (a part of) the main heat exchanger (1);
- a compressor (91) for compressing a gas drawn from a column top (41) of the second condenser (4);
- a high-purity oxygen rectification column (5) (comprising an oxygen rectifying portion or column top) into which an oxygen-containing liquid (including a gaseous form and a liquid form) drawn from (an intermediate or upper rectifying portion of) the first nitrogen rectifying portion (21) is introduced;
- an oxygen vaporizer (55) which is arranged in a lower portion (of the oxygen rectifying portion) of the high-purity oxygen rectification column (5) and serves to generate a vapour stream of oxygen gas; and
- an oxygen recondenser (7) into which a portion of the oxygen gas (vapour stream) generated in the oxygen vaporizer (55) is introduced, in order to condense (reliquefy) this oxygen gas.

The air separation units (A1, A2) may comprise:

- a feed air pipeline (L1) for the feed air which is passed through the main heat exchanger (1) and introduced into the intermediate or lower rectifying portion of the first nitrogen rectifying portion (21);
- a pipeline (L213) for feeding the gas (vaporized gas) drawn from the column top (213) of the first nitrogen rectifying portion (21) to the second nitrogen rectifying portion (22);
- a pipeline (L211*a*) for feeding an oxygen-rich liquid drawn from a bottom (211) of the first nitrogen rectifying portion (21) to the second condenser (4) (to be used as cold heat therein);
- a pipeline (L221) leading out from the bottom (221) of the second nitrogen rectifying portion (22), for feeding an oxygen-rich liquid by means of the liquid feed pump (8) to (the column top or upper rectifying portion of) the first nitrogen rectifying portion (21);
- a pipeline for feeding the oxygen-rich liquid from the second condenser (4) to the first condenser (3);
- a pipeline leading out from the column top (223) of the second nitrogen rectifying portion (22), for feeding the gas (vaporized gas) to the first condenser (3) to be condensed (cooled), and returning the condensed gas to the column top (223);
- a pipeline leading out from the column top (223) of the second nitrogen rectifying portion (22), for feeding the gas (vaporized gas) to the second condenser (4) to be condensed (cooled), and returning the condensed gas to the column top (223);
- a waste gas pipeline (L31) for a gas which is drawn from the column top (31) of the first condenser (3), passed through (a part of) the main heat exchanger (1), expanded by the expander (92), and passed through the main heat exchanger (1), from which it is drawn;
- a recycling pipeline (L41) for a gas which is drawn from the column top (41) of the second condenser (4), compressed by the compressor (91), passed through (a part of) the main heat exchanger (1), and introduced into the first nitrogen rectifying portion (21);
- a nitrogen gas line (L223) for passing a nitrogen-rich gas, which is drawn from the column top (223) of the second nitrogen rectifying portion (22), through the main heat exchanger (1), from which it is drawn;
- a pipeline (L212) leading out from (the intermediate or upper rectifying portion of) the first nitrogen rectifying portion (21), for introducing an oxygen-containing liquid (including a gaseous form and a liquid form) to (the oxygen rectifying portion (52) or column top (53) of) the high-purity oxygen rectification column (5); and
- a pipeline (L522) into which a portion of the oxygen gas (vapour stream) generated in the oxygen vaporizer (55) is introduced, the pipeline (L522) introducing this oxygen gas into the oxygen recondenser (7).

The air separation units (A1, A2) may comprise: a pipeline (L211*b*) through which an oxygen-rich liquid drawn from the bottom (211) of the first nitrogen rectifying portion (21) is introduced into the oxygen vaporizer (55) and then fed to the second condenser (4); a pipeline (L211*b*1) which branches from the pipeline (L211*b*) to feed the oxygen-rich liquid after usage in the oxygen vaporizer (55) into the oxygen recondenser (7), then merging into the waste gas pipeline (L31) upstream of the main heat exchanger (1); and a pipeline (L53) which merges the gas drawn from the column top (53) of the high-purity oxygen rectification column (5) into the waste gas pipeline (L31) upstream of the main heat exchanger (1).

The air separation unit (A1) may comprise a first extraction pipeline (L71) for extracting a high-purity oxygen liquid reliquefied in a bottom (71) of the oxygen recondenser (7).

The high-purity oxygen liquid extracted by the first extraction pipeline (L71) may be pressurized to a predetermined pressure by a pressurization apparatus and then fed to a point of demand.

The high-purity oxygen liquid extracted by the first extraction pipeline (L71) may be passed through the main heat exchanger (1) (vaporized) to form oxygen gas which is then fed to a point of demand.

The air separation unit (A2) may comprise an oxygen mist separator (75) on a primary side (in a lower portion) of the oxygen recondenser (7).

The pipeline (L522) may be set so as to introduce a portion of the oxygen gas (vapour stream) generated in the oxygen vaporizer (5) to below the oxygen mist separator (75).

The air separation unit (A2) may comprise: a second extraction pipeline (L72) for extracting the high-purity oxygen liquid from above the oxygen mist separator (75) in the oxygen recondenser (7); and a pipeline (L711) for drawing the high-purity oxygen liquid collected in the bottom (71) of the oxygen recondenser (7) and introducing the liquid into the high-purity oxygen rectification column (5) (above the oxygen vaporizer (55)).

The high-purity oxygen liquid extracted by the second extraction pipeline (L72) may be pressurized to a predetermined pressure by a pressurization apparatus and then fed to a point of demand.

The high-purity oxygen liquid extracted by the second extraction pipeline (L72) may be passed through the main heat exchanger (1) (vaporized) to form oxygen gas which is then fed to a point of demand.

Air separation units (B1, B2) according to another disclosure comprise: a nitrogen rectification column (200); and a high-purity oxygen rectification column (5) having a first oxygen rectifying portion (51) in which high-boiling-point components are concentrated, and a second oxygen rectifying portion (52) in which low-boiling-point components are concentrated. The first oxygen rectifying portion (51) and the second oxygen rectifying portion (52) may be separated due to constraints such as height constraints. A liquid feed pump (81) may be provided in order to feed an oxygen-rich liquid collected in a bottom (511) of the first oxygen rectifying portion (51) to a column top (523) of the second oxygen rectifying portion (52). The liquid feed pump (81) is used because there is a head difference.

The air separation units (B1, B2) may comprise: a main heat exchanger (1) for subjecting feed air to heat exchange; a nitrogen rectification column (200) (comprising an intermediate or lower rectifying portion) into which the feed air that has passed through the main heat exchanger (1) is introduced; first and second condensers (3, 4) into which a gas (vaporized gas) drawn from a column top (203) of the nitrogen rectification column (200) is introduced, the first and second condensers (3, 4) condensing (cooling) this gas and returning it to the column top (203); an expander (92) for expanding a gas drawn from a column top (31) of the first condenser (3), after the gas has passed through (a part of) the main heat exchanger (1); a compressor (91) for compressing a gas drawn from a column top (41) of the second condenser (4); a first oxygen rectifying portion (51) (comprising a rectifying portion or column top) into which an oxygen-containing liquid (including a gaseous form and a liquid form) drawn from (an intermediate portion 202 or upper rectifying portion of) the nitrogen rectification column (200) is introduced; a second oxygen rectifying portion (52) having a column top (523) into which an oxygen-rich liquid collected in the bottom (511) of the first oxygen rectifying portion (51) is introduced; an oxygen vaporizer (55) which is arranged in a lower portion (of the oxygen rectifying portion) of the second oxygen rectifying portion (52) and serves to generate a vapour stream of oxygen gas; and an oxygen recondenser (7) into which a portion of the oxygen gas (vapour stream) generated in the oxygen vaporizer (55) is introduced, in order to condense (reliquefy) this oxygen gas.

A pressurization apparatus (10) for pressurizing the high-purity oxygen liquid drawn from the bottom (71) of the oxygen recondenser (7) may also be provided.

The air separation units (B1, B2) may comprise: a feed air pipeline (L1) for the feed air which is passed through the main heat exchanger (1) and introduced into the intermediate or lower rectifying portion of the nitrogen rectification column (200); a pipeline (L201*a*) for feeding an oxygen-rich liquid drawn from a bottom (201) of the nitrogen rectification column (200) to the second condenser (4) (to be used as cold heat therein); a pipeline (not depicted) for feeding the oxygen-rich liquid (cold heat) from the second condenser (4) to the first condenser (3); a pipeline (not depicted) leading out from the column top (203) of the nitrogen rectification column (200), for feeding the gas (vaporized gas) to the first condenser (3) to be condensed (cooled), and returning the condensed gas to the column top (203); a pipeline (not depicted) leading out from the column top (203) of the nitrogen rectification column (200), for feeding the gas (vaporized gas) to the second condenser (4) to be condensed (cooled), and returning the condensed gas to the column top (203); a recycling pipeline (L41) for a gas which is drawn from the column top (41) of the second condenser (4), compressed by the compressor (91), passed through (a part of) the main heat exchanger (1), and introduced into the nitrogen rectification column (200); a waste gas pipeline (L31) for a gas which is drawn from the column top (31) of the first condenser (3), passed through (a part of) the main heat exchanger (1), expanded by the expander (92), and passed through the main heat exchanger (1), from which it is drawn; a nitrogen gas line (L203) for passing a nitrogen-rich gas, which is drawn from the column top (203) of the nitrogen rectification column (200), through the main heat exchanger (1), from which it is drawn; a pipeline (L202) leading out from (the intermediate or upper rectifying portion of) the nitrogen rectification column (200), for introducing an oxygen-containing liquid (including a gaseous form and a liquid form) into (the upper rectifying portion or column top (513) of) the first oxygen rectifying portion (51); a pipeline (L511) leading out from the bottom (511) of the first oxygen rectifying portion (51), for feeding an oxygen-rich liquid by means of the liquid feed pump (81) to (the column top (523) or upper rectifying portion of) the second oxygen rectifying portion (52); a pipeline (L523) for feeding a gas from the column top (523) of the second oxygen rectifying portion (52) to a gas phase in the lower rectifying portion or bottom (511) of the first oxygen rectifying portion (51); and a pipeline (L522) into which a portion of the oxygen gas (vapour stream) generated in the oxygen vaporizer (55) is introduced, the pipeline (L522) introducing this oxygen gas into the oxygen recondenser (7).

The air separation units (B1, B2) may comprise: a pipeline (L201*b*) through which an oxygen-rich liquid drawn from the bottom (201) of the nitrogen rectification column (200) is introduced into the oxygen vaporizer (55) and then fed to the second condenser (4); a pipeline (L201*b*1) which branches from the pipeline (L201*b*) to feed the oxygen-rich liquid after usage in the oxygen vaporizer (55) into the oxygen recondenser (7), then merging into the waste gas pipeline (L31) upstream of the main heat exchanger (1); and a pipeline (L513) which merges the gas drawn from the column top (513) of the first oxygen rectifying portion (51) into the waste gas pipeline (L31) upstream of the main heat exchanger (1).

The air separation units (B1, B2) may comprise: a third extraction pipe (L101) for extracting a pressurized high-purity oxygen liquid from the bottom of the pressurization apparatus (10); and a pipeline (L102) for introducing oxygen gas drawn from the pressurization apparatus (10) to above the oxygen vaporizer (55) in the second oxygen rectifying portion (52).

Furthermore, the air separation unit (B1, B2) may comprise a pipeline for introducing the oxygen gas drawn from the pressurization apparatus (10) into the oxygen recondenser (7).

The high-purity oxygen liquid extracted by the third extraction pipeline (L101) may be passed through the main heat exchanger (1) (vaporized) to form oxygen gas which is then fed to a point of demand.

The air separation unit (B1) may comprise a pipeline (L712) for introducing the high-purity oxygen liquid reliquefied in the bottom (71) of the oxygen recondenser (7) into the pressurization apparatus (10).

The air separation unit (B2) may comprise an oxygen mist separator (75) on a primary side (in a lower portion) of the oxygen recondenser (7).

The pipeline (L522) may be set so as to introduce a portion of the oxygen gas (vapour stream) generated in the oxygen vaporizer (5) to below the oxygen mist separator (75).

The air separation unit (B2) may comprise: a pipeline (L711) for drawing the high-purity oxygen liquid collected in the bottom (71) of the oxygen recondenser (7) and introducing the liquid into the second oxygen rectifying portion (52) (above the oxygen vaporizer (55)); and a pipeline (L721) for drawing the high-purity oxygen liquid from above the oxygen mist separator (75) in the oxygen recondenser (7), and feeding this liquid to the pressurization apparatus (10).

The air separation units (A1, A2, B1, B2) may also include one or more of the following:

- various measurement instruments such as flow rate measurement instruments, pressure measurement instruments, temperature measurement instruments, and liquid level measurement instruments;
- various valves such as control valves and gate valves;
- pipes for connecting the components; and
- a subcooler for subcooling gas.

The air separation units (A1, A2, B1, B2) may comprise a compressor-expander (9) which includes the expander (91) and the compressor (92).

At least some of the motive power obtained by the expander (91) is used for motive power in the compressor (10), whereby the motive power that can be recovered in the expander (91) can be efficiently utilized.

(Effects)

The high-purity oxygen liquid in which non-volatile impurities caused by the liquid feed pump, etc. are concentrated is vaporized with the non-volatile impurities being separated by the oxygen vaporizer, and the vapour stream is fed to the oxygen recondenser and recondensed, which thereby makes it possible to extract a high-purity oxygen liquid that is free from (substantially free from) non-volatile impurities. The non-volatile impurities can be removed so as to obtain high-purity oxygen responding to requirements at a point of demand.

Even if an impurity-containing liquid accompanies the high-purity oxygen gas when the high-purity oxygen is fed from the high-purity oxygen rectification column to the oxygen recondenser, the impurity-containing liquid is blocked by the oxygen mist separator and stored in the bottom of the oxygen recondenser. The impurity-containing liquid is returned from the bottom to the oxygen vaporizer by the pipeline L711. The high-purity oxygen liquid can then be extracted as the product from above the oxygen mist separator.

BRIEF DESCRIPTION OF THE DRAWINGS

Other features and advantages of the invention will be further disclosed in the description that follows, and in several embodiments provided as non-limiting examples in reference to the appended schematic drawings, in which:

FIG. 1 illustrates an air separation unit according to embodiment 1.

FIG. 2 illustrates an air separation unit according to embodiment 2.

FIG. 3 illustrates an air separation unit according to embodiment 3.

FIG. 4 illustrates an air separation unit according to embodiment 4.

DETAILED DESCRIPTION OF THE INVENTION

Several embodiments of the present disclosure will be described below. The embodiments described below are given as an example of the present disclosure. The present disclosure is in no way limited by the following embodiments, and also includes a number of variant modes which are implemented within a scope that does not alter the essential point of the present disclosure. It should be noted that not all the constituents described below are necessarily essential to the present disclosure. Upstream and downstream are based on a flow direction of a gas stream.

Embodiment 1

An air separation unit A1 according to embodiment 1 will be described with the aid of FIG. 1.

The air separation unit A1 comprises: a nitrogen rectification column 2 having a first nitrogen rectifying portion 21 in which high-boiling-point components are concentrated, and a second nitrogen rectifying portion 22 in which low-boiling-point components are concentrated; and a high-purity oxygen rectification column 5. The first nitrogen rectifying portion 21 and the second nitrogen rectifying portion 22 are separated because of constraints such as height constraints, and a liquid feed pump 8 is provided in order to feed an oxygen-rich liquid collected in a bottom 221 of the second nitrogen rectifying portion 22 to a column top 213 of the first nitrogen rectifying portion 21.

The air separation unit A1 comprises: a main heat exchanger 1 for subjecting feed air to heat exchange, an expander-compressor 9, and an oxygen recondenser 7.

The feed air that has passed through the main heat exchanger 1 is introduced into the first nitrogen rectifying portion 21. The feed air is introduced into a lower rectifying portion in this embodiment. A feed air pipeline L1 passes the feed air through the main heat exchanger 1 and introduces the feed air into the lower rectifying portion of the first nitrogen rectifying portion 21.

A gas (vaporized gas) drawn from the column top 213 of the first nitrogen rectifying portion 21 is introduced into the second nitrogen rectifying portion 22. The gas is introduced into a gas phase below a rectifying portion 222 or in the bottom 221 in this embodiment. A pipeline L213 feeds the gas (vaporized gas) drawn from the column top 213 of the first nitrogen rectifying portion 2 to the second nitrogen rectifying portion 22.

The gas (vaporized gas) drawn from a column top 223 of the second nitrogen rectifying portion 22 is introduced into first and second condensers 3, 4 which condense (cool) this gas and return it to the column top 223. The second condenser 4 is arranged above the first condenser 3 in this embodiment. A pipeline L211*a* feeds an oxygen-rich liquid drawn from a bottom 211 of the first nitrogen rectifying portion 21 to be used as cold heat in the second condenser 4. A pipeline is also provided for feeding the oxygen-rich liquid from the second condenser 4 to the first condenser 3.

An expander 92 of the expander-compressor 9 expands a gas drawn from a column top 31 of the first condenser 3, after the gas has passed through a part of the main heat exchanger 1. The expanded gas is passed through the main heat exchanger 1 and treated as waste gas. By way of a waste gas pipeline L31, the gas which is drawn from the column top 31 of the first condenser 3 is passed through a part of the main heat exchanger 1, expanded in the expander 92, and then passed through the main heat exchanger 1, from which it is drawn.

A compressor 91 of the expander-compressor 9 compresses the gas drawn from a column top 41 of the second condenser 4. The compressed gas passes through a part of the main heat exchanger 1 and is introduced into the gas phase in the bottom 211 of the first nitrogen rectifying portion 21. By way of a recycling pipeline L41, the gas which is drawn from the column top 41 of the second condenser 4 is compressed by the compressor 91, passed through a part of the main heat exchanger 1, and introduced into the first nitrogen rectifying portion 21.

A nitrogen-rich gas drawn from the column top 223 of the second nitrogen rectifying portion 22 is passed, by way of a nitrogen gas line L223, through the main heat exchanger 1, from which it is drawn.

An oxygen-containing liquid (including a gaseous form and a liquid form) drawn from an intermediate portion 212 of the first nitrogen rectifying portion 21 is introduced into the high-purity oxygen rectification column 5. A pipeline L212 draws the oxygen-containing liquid from the intermediate portion 212 of the first nitrogen rectifying portion 21 and introduces the liquid into a column top 53 of the high-purity oxygen rectification column 5.

An oxygen vaporizer 55 for generating a vapour stream of oxygen gas is provided in a lower portion of the oxygen rectifying portion of the high-purity oxygen rectification column 5. A pipeline L211*b* draws the oxygen-rich liquid from the bottom 211 of the first nitrogen rectifying portion 21 and uses this as cold heat in the oxygen vaporizer 55, after which the oxygen-rich liquid is fed to the second condenser 4 and used as cold heat.

A portion of the oxygen gas (vapour stream) generated in the oxygen vaporizer 55 is introduced into the oxygen recondenser 7, where the oxygen gas is condensed (reliquefied). A pipeline L522 draws a portion of the oxygen gas (vapour stream) generated in the oxygen vaporizer 55, and introduces the oxygen gas into the oxygen recondenser 7. A pipeline L211*b*1 which branches from a pipeline L211*b* feeds the oxygen-rich liquid after usage in the oxygen vaporizer 55 to the oxygen recondenser 7 for use as cold heat, then merges into the waste gas pipeline L31 upstream of the main heat exchanger 1.

The high-purity oxygen gas from which non-volatile impurities have been separated in the oxygen vaporizer 55 is fed via a pipeline L522 to the oxygen recondenser 7 where it can be recondensed as high-purity oxygen liquid free from non-volatile impurities.

A pipeline L53 draws the gas from the column top 53 of the high-purity oxygen rectification column 5 and merges into the waste gas pipeline (L31) upstream of the main heat exchanger (1).

A first extraction pipeline L71 extracts a high-purity oxygen liquid reliquefied in a bottom 71 of the oxygen recondenser 7. The high-purity oxygen liquid extracted by the first extraction pipeline L71 may be pressurized to a predetermined pressure by a pressurization apparatus and then fed to a point of demand. The high-purity oxygen liquid extracted by the first extraction pipeline L71 may be passed through the main heat exchanger 1 (vaporized) to form oxygen gas which is then fed to a point of demand.

Embodiment 2

An air separation unit A2 according to embodiment 2 will be described with the aid of FIG. 2. The air separation unit A2 of embodiment 2 mainly differs from the air separation unit A1 of embodiment 1 in that the air separation unit A2 comprises an oxygen mist separator. Components which are the same as those of embodiment 1 will not be described or will only be briefly described.

An oil mist separator 75 is provided on a primary side (in a lower portion) of the oxygen recondenser 7. The pipeline L522 introduces a portion of the oxygen gas (vapour stream) generated in the oxygen vaporizer 55 to below the oxygen mist separator 75.

A second extraction pipeline L72 extracts the high-purity oxygen liquid from above the oxygen mist separator 75 in the oxygen recondenser 7. A pipeline L711 draws the high-purity oxygen liquid collected in the bottom 71 of the oxygen recondenser 7 and introduces the liquid to above the oxygen vaporizer 55 in the high-purity oxygen rectification column 5. The high-purity oxygen liquid extracted by the second extraction pipeline L72 may be pressurized to a predetermined pressure by a pressurization apparatus and then fed to a point of demand. The high-purity oxygen liquid extracted by the first extraction pipeline L72 may be passed through the main heat exchanger 1 (vaporized) to form oxygen gas which is then fed to a point of demand.

The oxygen mist separator 75 may employ, for example: a water(-drop) separator, a mist eliminator, structured packing, or random packing, etc. A liquid fraction and impurities in the liquid fraction are removed from the oxygen gas in the vapour stream. When the vapour stream is introduced below the oxygen mist separator 75 and the vapour stream rises to pass through the oxygen mist separator 75, the high-concentration oxygen liquid in the bottom 71 rises together with the vapour stream but is blocked by the oxygen mist separator 75 and travels no further.

Embodiment 3

An air separation unit B1 according to embodiment 3 will be described with the aid of FIG. 3. The air separation unit B1 according to embodiment 3 comprises: a nitrogen rectification column 200; and a high-purity oxygen rectification column 5 having a first oxygen rectifying portion 51 in which high-boiling-point components are concentrated, and a second oxygen rectifying portion 52 in which low-boiling-point components are concentrated. The first oxygen rectifying portion 51 and the second oxygen rectifying portion 52 are separated because of constraints such as height constraints, and a liquid feed pump 81 is provided in order to feed an oxygen-rich liquid collected in a bottom 511 of the first oxygen rectifying portion 51 to a column top 523 of the second oxygen rectifying portion 52.

The air separation unit B1 comprises: a main heat exchanger 1 for subjecting feed air to heat exchange, an expander-compressor 9, and an oxygen recondenser 7.

The feed air that has passed through the main heat exchanger 1 is introduced into the nitrogen rectification column 200 via a pipe L1.

An oxygen-rich liquid drawn from a bottom 201 of the nitrogen rectification column 200 is fed to a second condenser 4 via a pipeline L201*a* to be used as cold heat. Furthermore, the oxygen-rich liquid is fed from the second condenser 4 to a first condenser 3.

A gas (vaporized gas) drawn from a column top 203 of the nitrogen rectification column 200 is introduced into the first and second condensers 3, 4 which condense (cool) this gas and return it to the column top 203.

An expander 92 of the expander-compressor 9 expands a gas drawn from a column top 31 of the first condenser 3 via a waste gas pipeline L31, after the gas has passed through a part of the main heat exchanger 1. The expanded gas is passed through the main heat exchanger 1 via the waste gas pipeline L31 and treated as waste gas.

A compressor 91 of the expander-compressor 9 compresses the gas drawn from a column top 41 of the second condenser 4 via a recycling pipeline L41. The compressed gas passes through a part of the main heat exchanger 1 via the recycling pipeline L41 and is introduced into the gas phase in the bottom 201 of the nitrogen rectification column 200.

A nitrogen-rich gas drawn from the column top 23 of the nitrogen rectification column 2 is passed, by way of a nitrogen gas line L203, through the main heat exchanger 1, from which it is drawn.

An oxygen-containing liquid (including a gaseous form and a liquid form) is introduced into a column top 513 of the first oxygen rectifying portion 51 from an intermediate portion 202 of the nitrogen rectification column 200 via a pipe L202. A pipeline L513 merges a gas, which is drawn from the column top 513 of the first oxygen rectifying portion 51, into the waste gas pipeline L31 upstream of the main heat exchanger 1.

An oxygen-rich liquid is drawn from the bottom 511 of the first oxygen rectifying portion 51 via a pipe L511 and introduced into the column top 523 of the second oxygen rectifying portion 52 by using a liquid feed pump 81. A pipeline L523 feeds a gas from the column top 523 of the second oxygen rectifying portion 52 to a gas phase in the bottom 511 of the first oxygen rectifying portion 51.

A pipeline L201*b* introduces an oxygen-rich liquid drawn from the bottom 201 of the nitrogen rectification column 200 into an oxygen vaporizer 55 to be used as cold heat, and then feeds the liquid to the second condenser 4. A pipeline L201*b*1 which branches from the pipeline L201*b* feeds the oxygen-rich liquid after usage in the oxygen vaporizer 55 to the oxygen recondenser 7 for use as cold heat, then merges into the waste gas pipeline L31 upstream of the main heat exchanger 1.

The oxygen vaporizer 55 for generating a vapour stream of oxygen gas is provided in a lower portion of the oxygen rectifying portion of the second oxygen rectifying portion 52.

A portion of the oxygen gas (vapour stream) generated in the oxygen vaporizer 55 is introduced into the oxygen recondenser 7 via a pipeline L522, where the oxygen gas is condensed (reliquefied).

A pressurization apparatus (10) pressurizes the high-purity oxygen liquid drawn from a bottom 71 of the oxygen recondenser 7 via a pipe L712.

A third extraction pipe L101 extracts a pressurized high-purity oxygen liquid from the bottom of the pressurization apparatus 10. The high-purity oxygen liquid extracted by the third extraction pipeline L101 may be passed through the main heat exchanger 1 (vaporized) to form oxygen gas which is then fed to a point of demand.

A pipeline L102 introduces oxygen gas drawn from the pressurization apparatus 10 to above the oxygen vaporizer 55 in the oxygen vaporizer 55 of the second oxygen rectifying portion 52.

Embodiment 4

An air separation unit B2 according to embodiment 4 will be described with the aid of FIG. 4. The air separation unit B2 of embodiment 4 mainly differs from the air separation unit B1 of embodiment 3 in that the air separation unit A2 comprises an oxygen mist separator. Components which are the same as those of embodiment 3 will not be described or will only be briefly described.

An oil mist separator 75 is provided on a primary side (in a lower portion) of the oxygen recondenser 7. The pipeline L522 introduces a portion of the oxygen gas (vapour stream) generated in the oxygen vaporizer 55 to below the oxygen mist separator 75.

A pipeline L721 extracts the high-purity oxygen liquid from above the oxygen mist separator 75 in the oxygen recondenser 7. A pipeline L711 draws the high-purity oxygen liquid collected in the bottom 71 of the oxygen recondenser 7 and introduces the liquid to above the oxygen vaporizer 55 in the high-purity oxygen rectification column 5. The high-purity oxygen liquid extracted by the pipeline L721 is fed to the pressurization apparatus 10.

The pressurization apparatus 10 pressurizes the high-purity oxygen liquid to a predetermined pressure. A third extraction pipe L101 extracts a pressurized high-purity oxygen liquid from the bottom of the pressurization apparatus 10. The high-purity oxygen liquid extracted by the third extraction pipeline L101 may be passed through the main heat exchanger 1 (vaporized) to form oxygen gas which is then fed to a point of demand.

A pipeline L102 introduces oxygen gas drawn from the pressurization apparatus 10 to above the oxygen vaporizer 55 in the second oxygen rectifying portion 52.

Embodiment 1, Example in FIG. 1

Feed air is supplied to a warm end of the main heat exchanger 1 at 10.31 barA, a temperature of 55° C., and a flow rate of 1050 $Nm^3/h$, cooled to −164.2° C., and then supplied to the first nitrogen rectifying portion 21 of the nitrogen rectification column 2. Nitrogen gas is drawn from the column top 223 of the second nitrogen rectifying portion 22 at 532 $Nm^3/h$, warmed in the main heat exchanger 1, and then drawn out.

A rich liquid comprising 39% oxygen is drawn from the bottom 211 of the first nitrogen rectifying portion 21 at 802 $Nm^3/h$, 137 $Nm^3/h$ thereof is supplied to the second nitrogen condenser 4, another 655 $Nm^3/h$ thereof is cooled to −175.4° C. in the oxygen vaporizer 55, after which 644 $Nm^3/h$ of that is supplied to the second nitrogen condenser 4 while the remaining 11 $Nm^3/h$ is supplied as a refrigerant to the oxygen recondenser 7, and after warming, is mixed with waste gas supplied from the expander 92 (expansion turbine), then warmed in the main heat exchanger 1 and discharged.

Recycled air is generated in the second nitrogen condenser 4 at 6.2 barA and 390 $Nm^3/h$, the pressure is boosted to 10.2 barA in the compressor 91, after which the recycled air is cooled in the main heat exchanger 1 then recycled to the first nitrogen rectifying portion 21.

Waste gas is further generated in the first nitrogen condenser 3 at 4.7 barA and 399 $Nm^3/h$, warmed to −141° C. in the main heat exchanger 1, and then cooled while simultaneously being expanded in the expander 92 (expansion turbine), once again warmed in the main heat exchanger 1, and then discharged.

In order to produce high-purity oxygen, an oxygen-containing liquid comprising 18% oxygen is drawn from the first nitrogen rectifying portion 21 at 106 $Nm^3/h$, decompressed to 1.5 barA, and then supplied to the column top 53 of the high-purity oxygen rectification column 5. Waste gas is drawn from the column top 53 at 97 $Nm^3/h$, mixed with the waste gas supplied from the expander 92 (expansion turbine), then warmed in the main heat exchanger 1 and discharged.

Oxygen gas is drawn at 9 $Nm^3/h$ from above (52) the oxygen vaporizer 55 in the high-purity oxygen rectification column 5 and liquefied in the oxygen recondenser 7, and a high-purity oxygen liquid is collected in the bottom 71.

The nitrogen rectification column 2 is divided into two parts above and below, and the liquid feed pump 8 (reflux liquid pump) is arranged intermediately between the two parts. In this example, if the number of theoretical stages in the nitrogen rectification column 2 is 68, and the point of division is an intermediate point of 34 in the number of theoretical stages, then the amount of reflux liquid treated by the liquid feed pump 8 is 998 $Nm^3/h$. For the number of theoretical stages, the stage at the bottommost point of the rectification column is taken as the first stage, and the stage at the topmost point is taken as the 68th stage. In this case, the point at which the oxygen-containing liquid is drawn is the point at the 15th theoretical stage, and the amount of reflux liquid supplied at this point is 933 $Nm^3/h$.

When metal impurities (non-volatile impurities) corresponding to 1 ppb are mixed with the reflux liquid from the liquid feed pump 8, the amount of metal impurities in the oxygen-containing liquid is as follows.

$$1\ [\text{ppb}]\times 998\ [\text{Nm}^3/\text{h}]\div 933\ [\text{Nm}^3/\text{h}]=1.07\ [\text{ppb}]$$

Additionally, the oxygen-containing liquid is introduced into the high-purity oxygen rectification column 5 at 106 $Nm^3/h$, and oxygen corresponding to 9 $Nm^3/h$ is concentrated in the bottom 51. The following metal impurities are contained in terms of the oxygen liquid.

$$1.07\ [\text{ppb}]\times 106\ [\text{Nm}^3/\text{h}]\div 9\ [\text{Nm}^3/\text{h}]=12.6\ [\text{ppb}]$$

In terms of oxygen gas in this embodiment 1, as shown in FIG. 1, metal impurities are not contained in the oxygen gas when oxygen is drawn from the bottom 51 of the high-purity oxygen rectification column 5 because these metal impurities are non-volatile, and by condensing the oxygen gas in the oxygen recondenser 7, it is possible to obtain a high-purity oxygen liquid free from metal impurities.

The liquid oxygen can be pressurized by externally input heat, without using a pump or a compressor, and is therefore suitable for supplying high-purity oxygen. In this method, the metal impurities are accumulated in the lower portion of the high-purity oxygen rectification column, but since there is sufficient space in the bottom of the high-purity oxygen rectification column, there are no problems such as obstruction of the oxygen flow path within the heat exchanger, even if the metal impurities build up over the period of operation of the oxygen rectification column, and the impurities can also be discharged by regularly purging with liquid oxygen.

Embodiment 2, Example in FIG. 2

The oxygen mist separator 75 is arranged in a lower portion of the oxygen recondenser 7. When the piping for drawing gas from above (52) the oxygen vaporizer 55 in the high-purity oxygen rectification column 5 is designed, there is a possibility of there being liquid drops around a drawing pipe inlet. These liquid drops include those which have fallen after being supplied to the high-purity oxygen rectification column 5 as the reflux liquid, and also those which result from the high-purity oxygen liquid (including metal impurities) collected in the bottom of the high-purity oxygen rectification column 5 being swept up so as to be entrained with oxygen gas supplied from the oxygen vaporizer 55, and these liquid drops may therefore contain non-volatile impurities.

Accordingly, the height is set at a sufficient level to prevent splashing and entrainment by taking account of the physical properties of the liquid drops and the flow rate of oxygen gas so that these liquid drops (microspray) do not enter the oxygen recondenser 7 while entrained with the oxygen gas which is drawn. However, the interior of the oxygen recondenser 7 is decompressed along with drawing of the high-purity oxygen liquid from the oxygen recondenser 7 and condensation of the oxygen gas, which produces a large difference in pressure between the high-purity oxygen rectification column 5 and the oxygen recondenser 7 (internal pressure of oxygen recondenser 7 is greater than internal pressure of oxygen rectification column 5), and the oxygen gas flows through the piping at a high rate as a result, so liquid drops may be carried into the oxygen recondenser 7. The mist separator 75 enables liquid drops carried into the oxygen recondenser 7 in this way to be separated from the oxygen gas, and oxygen gas free from liquid drops can be condensed in the oxygen recondenser 7.

Embodiment 3, Example in FIG. 3

The high-purity oxygen rectification column 5 is divided into two parts above and below. The liquid feed pump 81 (reflux liquid pump) is arranged at an intermediate portion. If the number of theoretical stages in the high-purity oxygen rectification column 5 is 59, and the point of division is an intermediate point of 30 in the number of theoretical stages, then the amount of reflux liquid treated by the liquid feed pump 81 is 69 $Nm^3/h$. When metal impurities corresponding to 1 ppb are mixed with the reflux liquid from the liquid feed pump 81, the following metal impurities are contained in terms of the oxygen liquid which may be drawn from the high-purity oxygen rectification column 5.

$$1\ [\text{ppb}]\times 69\ [\text{Nm}^3/\text{h}]\div 9\ [\text{Nm}^3/\text{h}]=7.7\ [\text{ppb}]$$

In terms of oxygen gas in this embodiment 3, as shown in FIG. 3, metal impurities are not contained in the oxygen gas vaporized by the oxygen vaporizer 55 when oxygen is drawn from the bottom 521 of the second oxygen rectifying portion 52 because these metal impurities are non-volatile, and by feeding the oxygen gas to the oxygen recondenser 7 to be condensed, it is possible to obtain a high-purity oxygen liquid free from metal impurities.

Embodiment 4, Example in FIG. 4

The oxygen mist separator 75 is arranged in a lower portion of the oxygen recondenser 7. The effects are the same as those of embodiment 2.

Other Embodiments

Although not explicitly stated, pressure regulators and flow rate controllers, etc. may be provided in each pipeline in order to regulate pressure and regulate flow.

Although not explicitly stated, control valves and gate valves, etc. may be provided in each line.

Although not explicitly stated, pressure regulators and temperature measurement devices, etc. may be provided in each column in order to regulate pressure and regulate temperature.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

KEY TO SYMBOLS

Main heat exchanger
Nitrogen rectification column
First condenser
Second condenser
High-purity oxygen rectification column
55 Oxygen vaporizer
Oxygen recondenser
Liquid feed pump
Expander-compressor

What is claimed is:

1. An air separation unit comprising:

a. a main heat exchanger configured to cool feed air via indirect heat exchange;

b. a nitrogen rectification column in fluid communication with the main heat exchanger and configured to receive the feed air from the main heat exchanger after cooling, the nitrogen rectification column having a first nitrogen rectifying portion in which high-boiling-point components are concentrated, and a second nitrogen rectifying portion in which low-boiling-point components are concentrated, the first nitrogen rectifying portion having an upper rectifying portion, an intermediate portion and a lower rectifying portion;

c. first and second condensers into which a gas drawn from a column top of the second nitrogen rectification portion is introduced, the first and second condensers being fluidly connected so as to condense the gas drawn from the column top of the second nitrogen rectification portion and return said gas to the column top of the second nitrogen rectification portion;

d. a high-purity oxygen rectification column;

e. a first pipeline fluidly connected to the first nitrogen rectifying portion and configured to introduce an oxygen-containing liquid containing non-volatile impurities, drawn from the first nitrogen rectifying portion, into an upper rectifying portion or a column top of the high purity oxygen rectification column;

f. a liquid feed pump fluidly connected to an oxygen rich pipeline configured to feed an oxygen-rich liquid collected in a bottom of the second nitrogen rectification portion to a column top of the first nitrogen rectifying portion;

g. an oxygen vaporizer which is arranged in a lower portion of the high-purity oxygen rectification column and is configured to generate a vapor stream of oxygen gas; and h. an oxygen recondenser fluidly connected to receive a portion of the vapor stream of oxygen gas generated in the oxygen vaporizer, the oxygen recondenser being configured to condense the portion of the vapor stream of oxygen gas.

2. The air separation unit according to claim 1, wherein the first pipeline is fluidly connected to a level of the first nitrogen rectifying portion above where the feed air is received.

3. The air separation unit according to claim 1, wherein the oxygen recondenser is fluidly connected directly to receive the portion of oxygen gas from the oxygen vaporizer without any intervening purification step.

4. A process for the separation of air, the process comprising the steps of:

a. providing the air separation unit as claimed in claim 1;

b. sending the feed air to the first nitrogen rectifying portion at a first level;

c. condensing the gas drawn from the column top of the second nitrogen rectification portion in the first and second condensers and returning the condensed gas to the column top of the second nitrogen rectification portion;

d. sending a bottom liquid from the first nitrogen rectifying portion to the first and second condensers;

e. introducing the oxygen-containing liquid containing non-volatile impurities, drawn from the intermediate section of the first nitrogen rectifying portion into the high-purity oxygen rectification column;

f. feeding the oxygen-rich liquid collected in the bottom of the second nitrogen rectification portion to the column top of the first nitrogen rectifying portion after pressurizing the oxygen-rich liquid using the liquid feed pump;

g. generating the vapor stream of oxygen gas using the oxygen vaporizer; and h. condensing the portion of the oxygen gas using the oxygen recondenser.

5. An air separation unit comprising:

a. a main heat exchanger configured to cool feed air via indirect heat exchange;

b. a nitrogen rectification column comprising an intermediate or lower rectifying portion into which the feed air that has passed through the main heat exchanger is introduced;

c. first and second condensers into which a gas drawn from a column top of the nitrogen rectification column is introduced, the first and second condensers being fluidly connected so as to condense this gas and return it to the column top;

d. a reflux pipeline configured to feed an oxygen-rich liquid drawn from a bottom of the nitrogen rectification column to the second condenser;

e. a second reflux pipeline configured to feed the oxygen-rich liquid from the second condenser to the first condenser;

f. a high-purity oxygen rectification column having a first oxygen rectifying portion in which high-boiling-point components are concentrated, and a second oxygen rectifying portion in which low-boiling-point components are concentrated;

g an oxygen vaporizer which is arranged in a lower portion of the second oxygen rectifying portion and serves to generate a vapor stream of oxygen gas; and h. an oxygen recondenser fluidly connected to the oxygen vaporizer and configured to receive a portion of the oxygen gas generated in the oxygen vaporizer, the oxygen recondenser further configured to condense this oxygen gas; and i. a liquid feed pump fluidly connected to a pipeline configured to feed an oxygen-rich liquid containing non-volatile impurities collected in a bottom of the first oxygen rectifying portion to a column top of the second oxygen rectifying portion.

6. The air separation unit according to claim 5, further comprising an oxygen mist separator on a lower portion of the oxygen recondenser, wherein a portion of vapor stream of oxygen gas generated in the oxygen vaporizer is introduced below the oxygen mist separator.

7. A method for reducing or removing non-volatile impurities in high-purity oxygen liquid within an air separation system, the method comprising:

separating air in a rectification column system to produce an oxygen-containing liquid;

transferring a portion of the oxygen-containing liquid within the rectification column system using a liquid feed pump, wherein the liquid feed pump introduces non-volatile impurities into the oxygen-containing liquid;

receiving the oxygen-containing liquid containing non-volatile impurities in an oxygen vaporizer;

vaporizing the oxygen-containing liquid in the oxygen vaporizer to produce a vaporized oxygen stream and a liquid phase within the oxygen vaporizer, wherein the liquid phase comprises the non-volatile impurities; and recondensing the vaporized oxygen stream in an oxygen recondenser to produce a high-purity oxygen liquid substantially free of the non-volatile impurities.

8. The method according to claim 7, further comprising accumulating the separated non-volatile impurities in a bottom portion of the oxygen vaporizer, and periodically purging the accumulated non-volatile impurities from the oxygen vaporizer.

9. The method according to claim 7, wherein the rectification column system comprises a nitrogen rectification column having a first nitrogen rectifying portion and a second nitrogen rectifying portion, and wherein the step of transferring the portion of the oxygen-containing liquid uses the liquid feed pump to feed an oxygen-rich liquid collected in a bottom of the second nitrogen rectification portion to a column top of the first nitrogen rectifying portion.

10. The method according to claim 9, wherein the oxygen-containing liquid containing non-volatile impurities is drawn from an intermediate or upper rectifying portion of the first nitrogen rectifying portion and introduced into a high-purity oxygen rectification column.

11. The method according to claim 7, wherein the rectification column system comprises a high-purity oxygen rectification column having a first oxygen rectifying portion and a second oxygen rectifying portion, and wherein the step of transferring the portion of the oxygen-containing liquid uses the liquid feed pump to feed an oxygen-rich liquid collected in a bottom of the first oxygen rectifying portion to a column top of the second oxygen rectifying portion.

12. The method according to claim 7, wherein the step of recondensing the vaporized oxygen stream comprises introducing the vaporized oxygen stream below an oxygen mist separator located within the oxygen recondenser, and extracting the high-purity oxygen liquid from above the oxygen mist separator.

13. The method according to claim 7, wherein the oxygen recondenser is fluidly connected directly to receive the vaporized oxygen stream without any intervening purification step between the oxygen vaporizer and the oxygen recondenser.

14. The method according to claim 7, wherein the non-volatile impurities comprise one or more of metal particles, metal oxide particles, and siloxanes.

* * * * *